US005361321A

United States Patent [19]

Marino

[11] Patent Number: 5,361,321

[45] Date of Patent: Nov. 1, 1994

[54] PORTABLE ELECTRIC HEATER DEENERGIZED BY A TIP-OVER RESPONSIVE ACTUATOR

[75] Inventor: Frank Marino, Upton, Mass.

[73] Assignee: Duracraft Corporation, Whitinsville, Mass.

[21] Appl. No.: 928,574

[22] Filed: Aug. 13, 1992

[51] Int. Cl.[5] ..... F24C 7/08; H05B 1/02; H01H 9/20; F24H 3/00

[52] U.S. Cl. ..... 392/373; 200/61.41; 200/61.42; 200/61.52; 200/334; 392/347; 392/365; 392/407

[58] Field of Search ..... 392/347, 365–369, 392/373–376, 411, 426–428, 407; 200/334, 61.41, 61.42, 61.52

[56] References Cited

U.S. PATENT DOCUMENTS

| | | | |
|---|---|---|---|
| 2,694,135 | 11/1954 | Brockmole | 392/426 X |
| 2,883,512 | 4/1959 | Winther | 392/376 |
| 3,267,255 | 8/1966 | Schulz | 392/368 X |
| 4,906,818 | 3/1990 | Lumpp et al. | 392/375 |

FOREIGN PATENT DOCUMENTS

| | | | |
|---|---|---|---|
| 61-62730 | 3/1986 | Japan | 392/376 |

*Primary Examiner*—Anthony Bartis
*Attorney, Agent, or Firm*—John E. Toupal; Harold G. Jarcho

[57] ABSTRACT

A portable electric heater including a housing having a rear wall, a substantially planar front wall, a bottom support and a top wall. Retained by the housing are a resistive heating element and an electrical circuit for connecting the heating element to an electrical power source. The circuit includes a switch having a closed condition that connects the heating element to the electrical power source and an open condition that disconnects the heating element from the electrical power source. Included with the switch is a manually operable actuator projecting from the front wall and movable in a single motion between a stable first position producing the closed condition and a stable second position producing the open condition, and wherein the actuator is shaped and arranged to be moved into the second position in response to contact with a substantially planar surface.

17 Claims, 1 Drawing Sheet

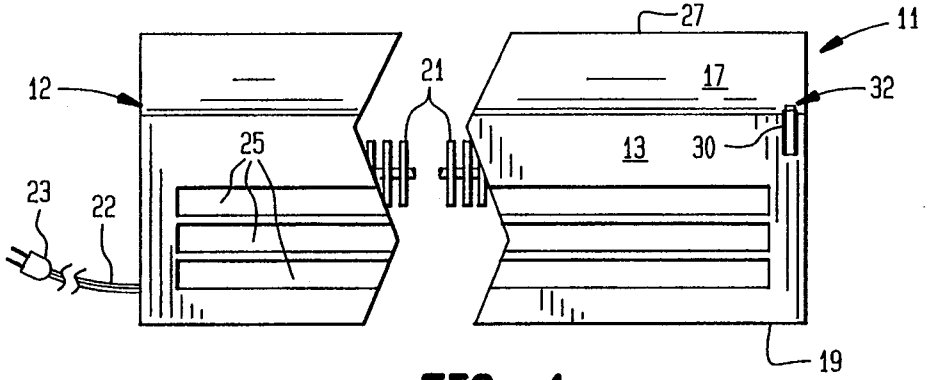
FIG. 1
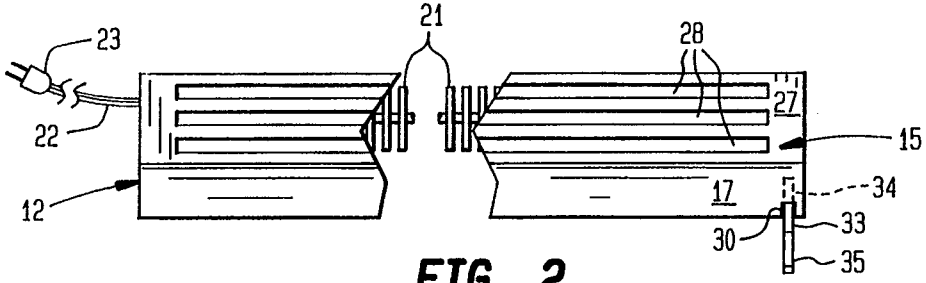
FIG. 2
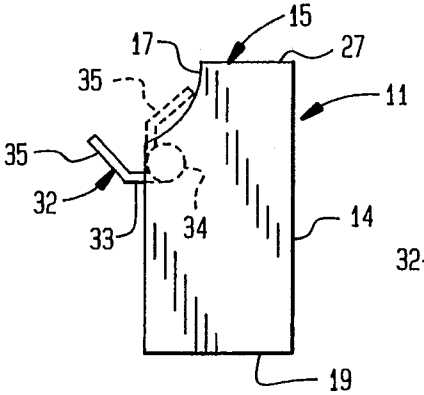
FIG. 3
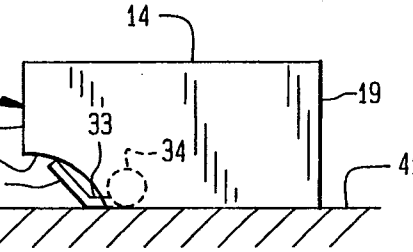
FIG. 4
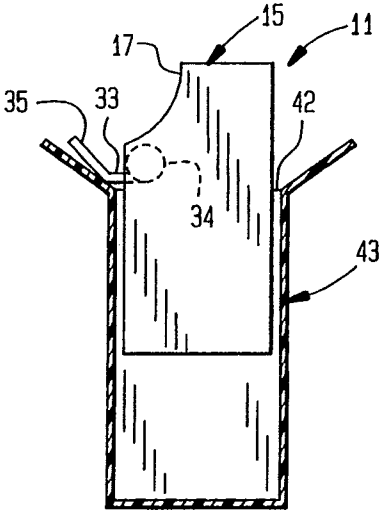
FIG. 5
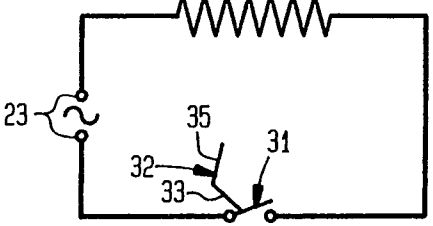
FIG. 6
FIG. 7

PORTABLE ELECTRIC HEATER DEENERGIZED BY A TIP-OVER RESPONSIVE ACTUATOR

BACKGROUND OF THE INVENTION

This invention relates generally to a portable electric baseboard heater and, more particularly, to a portable electric baseboard heater having a safety shutoff switch.

Portable electric heaters are used extensively to heat various types of environments. Typically such heaters are equipped with a power cord for connection to a conventional power outlet and a on-off switch for controlling a resistive heating element. Safe operation of such heaters requires that they be energized only when in a predetermined orientation. For that reason, many heaters are provided with auxiliary tip-switches that prevent energization of the heating element with the heater in other than the predetermined operating orientation. Although providing an important safety feature, conventional tip-switches are relatively expensive and add significantly to the cost of the heating unit. Another problem associated with portable electric heaters results from shipment thereof with an on-off switch in an on position. Such a condition commonly results in undesirable energization of the heater's heating element in response to initial insertion by a user of a power cord plug into an electrical outlet.

The object of this invention, therefore, is to provide an improved portable electric baseboard heater that alleviates the problems described above.

SUMMARY OF THE INVENTION

The invention is a portable electric heater including a housing having a rear wall, a substantially planar front wall, a bottom support and a top wall; the housing defining an air inlet and an air outlet. Retained by the housing are a resistive heating element; and an electrical circuit for connecting the heating element to an electrical power source. The circuit includes switch adapted in a closed condition to connect the heating element to the electrical power source and in an open condition to disconnect the heating element from the electrical power source. Included with the switch a manually operable actuator movable between a first stable position producing the closed condition and a second stable position producing the open condition. The actuator is shaped and arranged to be moved into the second position in response to contact with a substantially planar surface and thereby prevent energization of the heating element with the heater tipped on its front wall.

According to one feature of the invention, the actuator comprises an arm mounted for pivotal movement between the first and second positions, and the arm in the first position projects outwardly from the front wall and in the second position is substantially aligned therewith. The pivotable arm facilitates desired operation of the switch in response to engagement between the front wall and a surface such as the floor.

According to other features of the invention, the arm in moving from the first position to the second position moves toward the top wall, and its first position includes an outer end portion projecting outwardly and upwardly from the front wall. This arrangement facilitates closing of the switch by a packing carton to prevent shipment of the heater in an on condition.

According to yet another feature of the invention, the top wall defines a recess for receiving the outer end portion with the arm in its second position. The recess accommodates the arm when the front wall abuts a planar surface such as the floor.

DESCRIPTION OF THE DRAWINGS

These and other objects and features of the invention will become more apparent upon a perusal of the following description taken in conjunction with the accompanying drawings wherein:

FIG. 1 is a front elevational view of a portable heater unit;

FIG. 2 is a top view of the heater shown in FIG. 1;

FIG. 3 is an end view of the heater shown in FIGS. 1 and 2;

FIG. 4 is an end view of the heater in a tipped over condition;

FIG. 5 is a sectional view showing the heater of FIGS. 1–3 partially within a shipping carton;

FIG. 6 is a circuit diagram employed with the heater unit of FIGS. 1–3; and FIG. 7 is a fragmentary sectional view showing the relationship of the switch actuator to the switch.

DESCRIPTION OF THE PREFERRED EMBODIMENT

A portable electric heater 11 includes a housing 12 having a planar front wall 13, a rear wall 14, a top wall 15 and a bottom support wall 19. Included in the top wall 15 is an arcuate portion 17 that defines a recess. A conventional resistive heating element 21 is mounted in the housing 12 and is connected to a power cord 22 terminating with a male plug 23. Defined by the front wall 13 are a plurality of openings 25 that form an air inlet to the housing 12. Similarly formed in a planar portion 27 of the top wall 15 are a plurality of openings 28 that form an air outlet in the housing 12.

Also mounted within the housing 12 and electrically connected to the resistive heating element 21 is an electrical on-off switch 31. The switch 31 includes a manually operable actuator arm 32 projecting through a slot 30 in the front wall 13. An inner length portion 33 of the arm 32 is fixed to a pivotable on-off switch mechanism 34 within the housing 12 and an outer end portion 35 forms an obtuse angle with the inner portion 33. The actuator arm 32 is manually operable between a stable position shown by solid lines in FIG. 3 and an off position shown by dashed lines therein. As shown in FIG. 6, the resistive heating element 21 is connected to the electrical plug 23 by the on-off switch mechanism 34.

During proper use, the electric heater unit 11 is oriented in the manner shown in FIGS. 1–3 with the bottom wall 19 resting on a suitable support surface such as the floor and the rear wall 14 engaging a suitable planar surface such as a wall. After insertion of the electrical plug 23 into a conventional outlet, the switch 31 can be operated to produce energization of the resistive heating element 21 and creating airflow that enters the air inlet 25, acquires heat from the heating element 21 and is discharged through the air outlet 28.

As shown in FIG. 3, with the switch 31 in its on position, the outer end portion 35 of the actuator arm 32 projects outwardly and upwardly from the planar front wall 13. Conversely, with the switch 31 in its off position the portion 33 of the actuator arm 32 is substantially coplanar alignment with the planar front wall and the outer end portion 35 is received by the recess formed by the surface 17. In the event that the electric heater unit 11 tips forwardly producing engagement of the front wall 13 with a planar support surface 41 as shown in FIG. 4, the switch arm 32, if in its on position will be engaged thereby and automatically pivoted to its off position. Thus, energization of the resistive heating element 21 is prevented with the heater unit 11 in the unsafe position illustrated.

The switch 31 additionally functions to prevent undesirable shipment of the heater unit 11 with the switch 31 in an on position. As shown in FIG. 5, during insertion of the unit 11 into an open upper end 42 of a shipping carton 43, the actuator arm 32, if in an on position will engage the carton 43 and be pivoted into its off position.

Obviously, many modifications and variations of the present invention are possible in light of the above teachings. It is to be understood, therefore, that the invention can be practiced otherwise than as specifically described.

What is claimed is:

1. A portable electric heater comprising:

a housing having a rear wall, a substantially planar front wall, a bottom support means and an top wall; said housing defining an air inlet and an air outlet and resting on said bottom support means during use of said heater;

a resistive heating element retained in said housing and adapted to be heated be electrical current; and circuit means for connecting said heating element to an electrical power source, said circuit means comprising a switch adapted in a closed condition to connect said heating element to said electrical power source and in an open condition to disconnect said heating element from said electrical power source, said switch including a manually operable actuator projecting from said front wall and movable in a single motion between a first stable position producing said closed condition and a second stable position producing said open condition, and wherein said actuator is shaped and arranged to be moved into said second stable position in response to contact of said actuator with a substantially planar surface.

2. An electric heater according to claim 1 wherein said actuator comprises an arm mounted for pivotal movement between said first and second positions.

3. An electric heater according to claim 2 wherein said arm in said first position projects outwardly from said front wall and in said second position is substantially in coplanar alignment therewith.

4. An electric heater according to claim 3 wherein said arm in moving from said first position to said second position moves toward said top wall.

5. An electric heater according to claim 4 wherein said arm in said first position includes an outer end portion projecting outwardly and upwardly from said front wall.

6. An electric heater according to claim 5 wherein said top wall defines a recess for receiving said outer end portion with said arm in said second position.

7. An electric heater according to claim 1 wherein said circuit means comprises a plug for insertion into an electrical outlet socket.

8. An electric heater according to claim 7 wherein said actuator comprises an arm mounted for pivotal movement between said first and second positions.

9. An electric heater according to claim 8 wherein said arm in said first position projects outwardly from said front wall and in said second position is substantially in coplanar alignment therewith.

10. An electric heater according to claim 9 wherein said arm in moving from said first position to said second position moves toward said top wall.

11. An electric heater according to claim 10 wherein said arm in said first position includes an outer end portion projecting outwardly and upwardly from said front wall.

12. An electric heater according to claim 11 wherein said top wall defines a recess for receiving said outer end portion with said arm in said second position.

13. An electric heater according to claim 1 wherein said actuator comprises an arm mounted for pivotal movement between said first and second positions.

14. An electric heater according to claim 13 wherein said arm in said first position projects outwardly from said front wall and in said second position is substantially in coplanar alignment therewith.

15. An electric heater according to claim 14 wherein said arm in moving from said first position to said second position moves toward said top wall.

16. An electric heater according to claim 15 wherein said arm in said first position includes an outer end portion projecting outwardly and upwardly from said front wall.

17. An electric heater according to claim 16 wherein said top wall defines a recess for receiving said outer end portion with said arm in said second position.

* * * * *